US005179846A

United States Patent [19]

Lin

[11] Patent Number: 5,179,846

[45] Date of Patent: Jan. 19, 1993

[54] CLOTH WINDING DEVICE FOR CIRCULAR KNITTING MACHINE

[76] Inventor: Chin-Yung Lin, No. 57, Wu Chone 7th Rd., Wu Gu Industry Area, Wu Gu hsiang, Taipei hsien, Taiwan

[21] Appl. No.: 605,338

[22] Filed: Oct. 30, 1990

[51] Int. Cl.[5] ..... D04B 15/88

[52] U.S. Cl. ..... 66/149 R; 242/67.2

[58] Field of Search ..... 74/395, 402; 242/67.2, 242/75.5; 66/149 R, 151

[56] References Cited

U.S. PATENT DOCUMENTS

| | | | |
|---|---|---|---|
| 265,212 | 9/1882 | Anderson | 242/75.5 |
| 1,093,933 | 4/1914 | Jenkins | 242/75.5 |
| 1,517,992 | 12/1924 | Howie | 66/151 |
| 2,034,543 | 3/1936 | Twiss et al. | 242/67.2 |
| 2,375,602 | 5/1945 | Wickham | 74/402 |
| 2,753,128 | 7/1956 | Thomas et al. | 242/75.5 |
| 2,845,232 | 7/1958 | Johnson et al. | 242/67.2 |
| 3,148,558 | 9/1964 | Stevens | 74/395 |
| 3,344,740 | 10/1967 | Hilton | 242/75.5 |
| 4,233,825 | 11/1980 | Glaspie | 66/149 R X |
| 4,879,886 | 11/1989 | Okada et al. | 66/151 |

*Primary Examiner*—Werner H. Schroeder
*Assistant Examiner*—John J. Calvert
*Attorney, Agent, or Firm*—Varndell Legal Group

[57] ABSTRACT

This invention provides a cloth winding device of a circular knitting machine. A gear box is provided on the swivel frame of the machine. In the box, there are provided sets of fine adjustment gears and adjacent coarse adjustment gears on their respective shafts so that power is transmitted from the coarse adjustment gears through the rear row gears to the fine adjustment gears and then outputs from the cloth pulling shaft. The cloth winding shaft on the opposite side is driven by the respective bevel gears. Thereby, a multiple of speed ratios can selectively obtained by means of the adjustment devices provided on the gear box. The cloth winding roller is driven by the cloth pulling shaft. By the cooperation of a rocking arm and its related spring, the cloth roller can be raised or lowered automatically in accordance with the size of the cloth roll.

10 Claims, 8 Drawing Sheets

| | a | b | c | d | e | f | g | h | i | j | k | l | m | n |
|---|---|---|---|---|---|---|---|---|---|---|---|---|---|---|
| A | 8,00 | 7,7 | 7,4 | 7,17 | 6,89 | 6,62 | 6,34 | 6,00 | 5,8 | 5,5 | 5,24 | 4,96 | 4,69 | 4,4 |
| B | 4,00 | 3,86 | 3,72 | 3,58 | 3,44 | 3,31 | 3,17 | 3,00 | 2,89 | 2,75 | 2,62 | 2,48 | 2,34 | 2,20 |
| C | 2,00 | 1,93 | 1,86 | 1,79 | 1,72 | 1,65 | 1,58 | 1,51 | 1,44 | 1,37 | 1,31 | 1,24 | 1,17 | 1,10 |
| D | 1,00 | 0,96 | 0,93 | 0,89 | 0,86 | 0,82 | 0,79 | 0,75 | 0,72 | 0,68 | 0,65 | 0,62 | 0,58 | 0,55 |

CLOTH WINDING DEVICE FOR CIRCULAR KNITTING MACHINE

BACKGROUND OF THE INVENTION

This invention relates to a cloth winding device for a circular knitting machine, and more particularly to a winding device which can be conveniently and simply operated to adjust the rotation speed of the roller on which the cloth is wound so that the cloth has an even tightness, and a uniform thread distance and yard weight.

To knit cloths different in tightness and yard weight by a conventional circular knitting machine, the rotation speed of the roller on which the cloth is wound must be adjusted correspondingly. This is usually done by the use of stepless speed-changing means or by replacing the relevant gears manually. However, these ways of adjusting the rotation speed of the roller involve drawbacks described hereinafter.

As to the use of stepless speed-changing means for adjusting the rotation speed of the roller on which the cloth is wound in a conventional circular knitting machine, the tightness of the produced cloth is often uneven due to the slippage of the belts in the transmission system of the machine. Moreover, to produce cloths different in yard weight, it is necessary to perform the cloth production and then weigh the resulting product until the cloth having a correct yard weight can be obtained. This is quite labor consuming. Furthermore, the quality of the cloth obtained by this way is relatively unsteady.

As to the use of the conventional speed changing gears, although a relatively positive and good knitting effect can be achieved by this way, it is time and labor consuming to replace the original gears with those of different transmission ratio in order that the machine can produce a cloth having a specific thread distance and yard weight due to the fact that a lot of times of gear replacing and alignment by manual operation are usually needed before a desired transmission ratio can be obtained. In addition, the knitted cloth is apt to be dirtied upon in replacing the gears manually.

Another disadvantage which often occurs in changing the speed of the roller by either of the conventional ways, i.e., a cloth of nonuniform thread distance and of an uneven yard weight is formed in the same cloth batch (roll) due to nonuniform transmission ratio or an impositive transmission. In even worse cases, the knitting needles are worn seriously due to the uneven tightness of the cloth, and therefore the lives thereof will be significantly shortened.

Moreover, when the production of the cloth has been finished, it is usually required to roll up the cloth onto the respective rotating roller whose rotating speed has been chosen according to the desired yard weight and thread distance of the cloth so that the roller can roll up the cloth at that speed.

However, upon rolling up the cloth, the diameter of the cloth roll is increasing, i.e., the cloth roll is becoming bigger and bigger. In the meantime, the roller keeps at a constant speed. Those facts consequently result in an uneven tightness in the cloth roll.

The primary cause of this undesired result is in that the tension effected by the cloth roll to the cloth is relatively higher and the cloth is rolled up in a higher tightness when the cloth roll is smaller. In contrast, the tension effected to the cloth is lower when the cloth roll is bigger. This results in the outer layers of the cloth roll having a lower tightness and inner layers of a higher tightness.

Such a cloth roll having different tightness in outer and inner layers will have different yard weights in outer and inner layers. Moreover, in knitting striped cloth, the outer layer cloth and the inner layer cloth will have a different stripe distance. According to the inventor's experience, the difference between the stripe distances at two ends of a yard of striped cloth can be up to a half inch. This will result in an undesired cloth quality.

Furthermore, although the winding roller of a conventional knitting machine is provided with a manual tightness-adjusting means, an excessive tightness in the cloth often occurs and consequently it is hard to disengage the winding roller with the cloth roll after the tightness-adjusting means is initially adjusted to prevent a inadequate final tightness in the cloth roll. However, after if the tightness-adjusting means is adjusted to prevent the excessive tightness, the cloth occasionally cannot be rolled up properly or even will drop down to be squeezed between the bottom gears. In the latter case, the whole cloth winder can be damaged.

SUMMARY OF THE INVENTION

Accordingly, the primary object of the invention is to provide a positive cloth winding device for a circular knitting machine wherein a gear box is provided on the swivel frame of the machine. In the box, there are provided sets of fine adjustment gears and adjacent coarse adjustment gears on their respective shafts so that power is transmitted from the coarse adjustment gears through the rear row gears to the fine adjustment gears and then outputs from the cloth pulling shaft to provide over 50 precision speed ratios. Thereby, the cloth can have a specific consistent thread distance and yard weight and a relatively even tightness and consequently the wearing condition of the knitting needles can be alleviated and their lives be prolonged. In addition, the speed changing operation can be conveniently achieved by an external handle.

To overcome the forementioned drawbacks of the conventional cloth winding roller, another object of the invention is to provide a cloth roller which can automatically adjust the tightness of the cloth. The roller is coupled with one end of a rocking arm. The other end of the rocking arm is pivoted on a supporting shaft. A cantilever extends rearward of the rocking arm and is joined with the bottom end of a spring. The top end of the spring is attached to the adjusting block. Thereby, a floating roller is provided so that in the cloth winding process, the roller can adjust itself automatically. When the cloth roll is small, the cloth pulling force is relatively larger and the rocking arm is pulled up by the cloth to slightly slacken the transmission belt. In contrast, when the cloth roll is big, the weight of the roll becomes a dominant factor and, the pulling force is relatively small and therefore the rocking arm is pressed down to in turn tighten the transmission belt. Thereby, an even tightness of the cloth can be achieved.

Other objects and advantages of this invention will be apparent from the following description, the accompanying drawings and the appended claims.

BRIEF DESCRIPTION OF THE DRAWINGS

A preferred embodiment of the invention will now be described by way of example and with reference to the accompanying drawings, in which.

DETAILED DESCRIPTION OF THE PREFERRED EMBODIMENT

Figure 1:
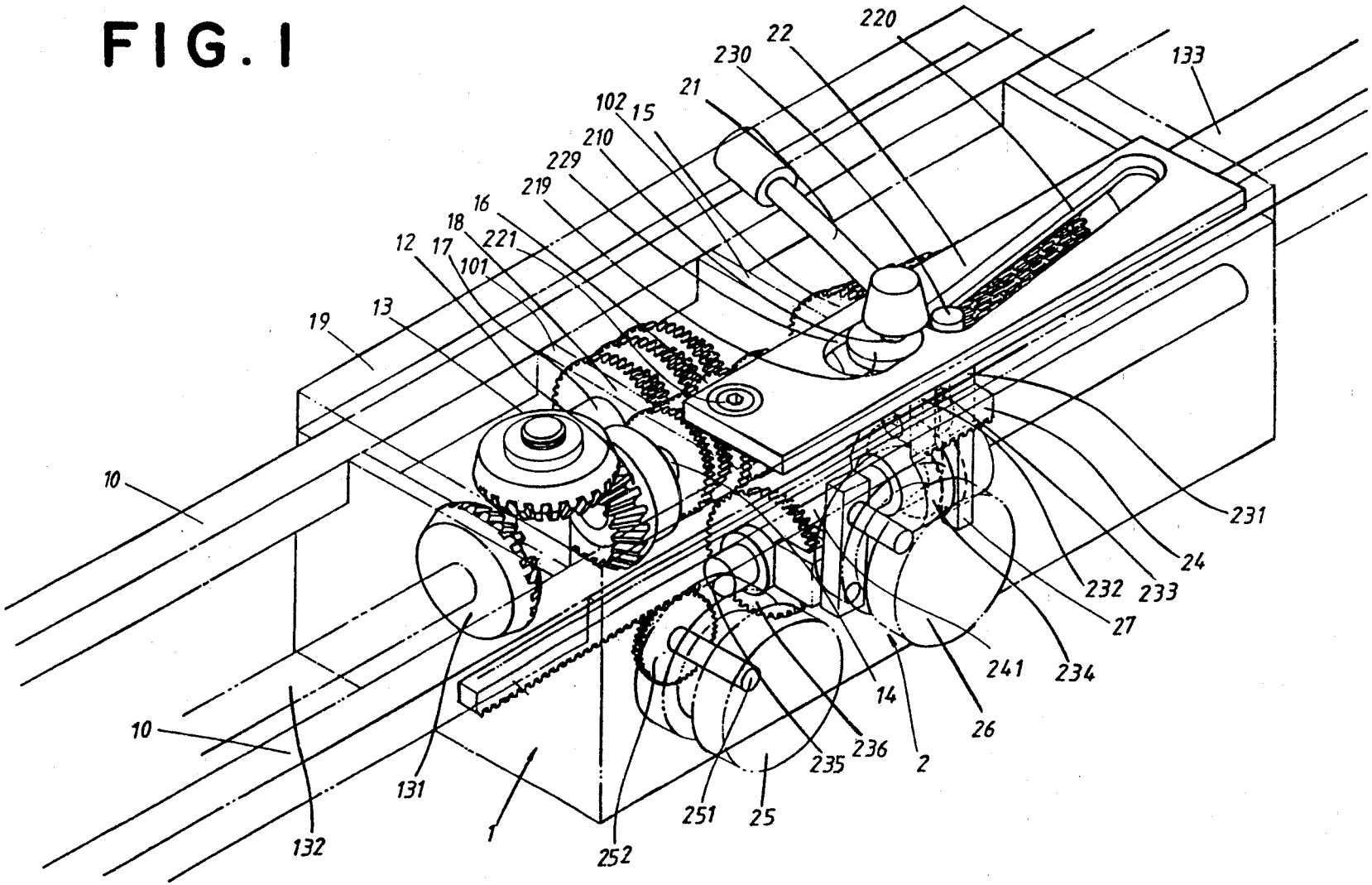
FIG. 1 is a schematic perspective view of a gear box mounted on a swivel frame of a circular knitting machine in accordance with the invention.
Figure 2:
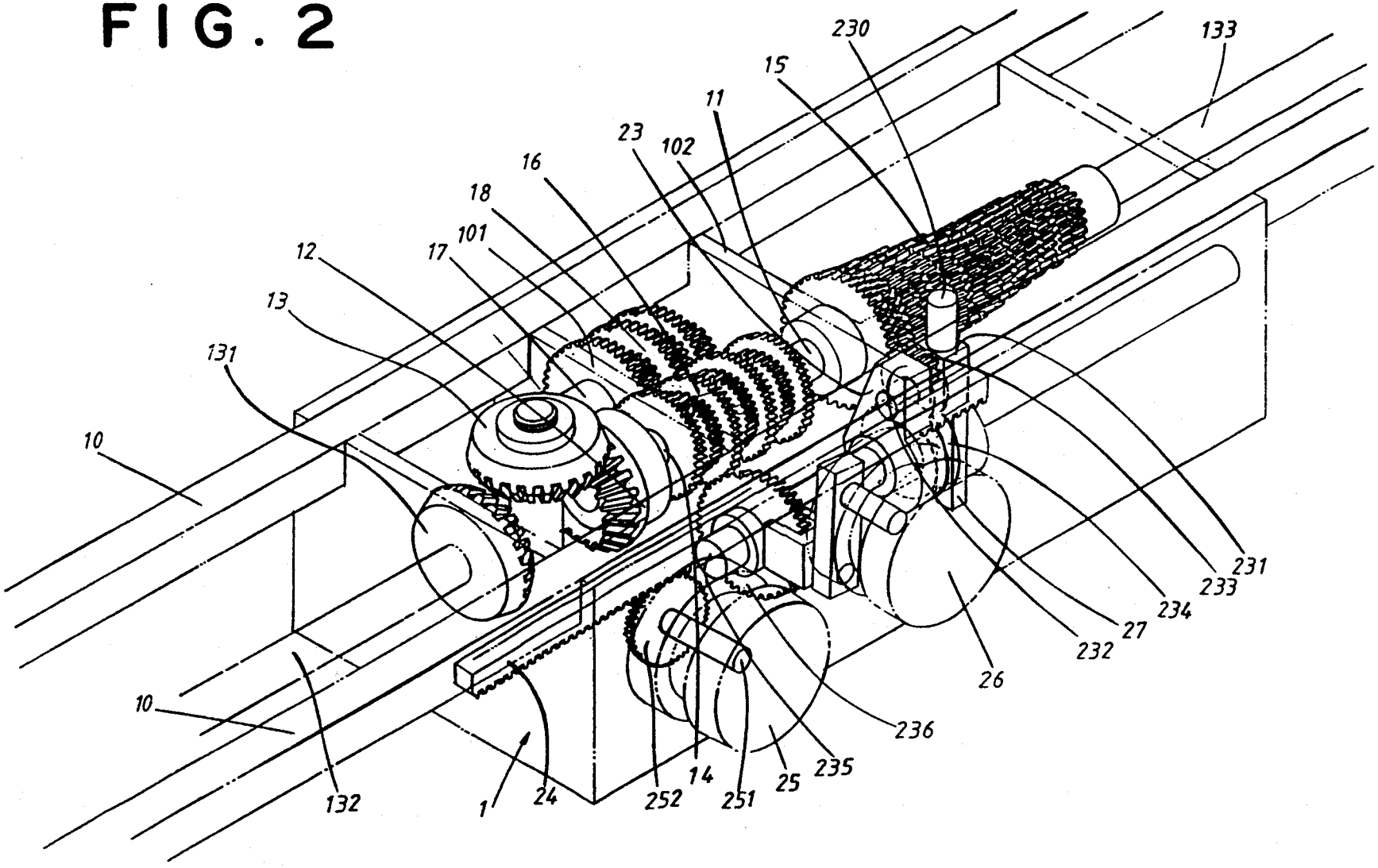
FIG. 2 is an illustration similar to FIG. 1 wherein the adjusting handle is removed.

Referring to FIGS. 1 and 2, in the cloth winding device for a circular knitting machine in accordance with the invention, a gear box case 1 is mounted on the supporting rods 10 of the swivel frame of the knitting machine. In the case 1, there is provided a shaft 11 (FIG. 2) sleeving thereon a sleeve 14 on which there is mounted an end bevel gear 12 so that the latter is meshed with a bevel gear 13 which is provided within the base of the circular knitting machine and has a vertical axis. On the opposite side, the gear 13 drives another bevel gear 131 together with the cloth-winding power shaft 132. On the shaft 11, there are rotatably provided a multiple sets of gears 16 (for example, four sets of gears as shown in FIG. 2) for coarse adjustment with the leftmost set of gears 16 being secured to sleeve 14. The gears 16 are meshed with the reduction gears 18 on the rear row shaft 17. Moreover, on the other side of the case 1, there are provided a plurality of stepwise disposed gears 15 having different numbers of teeth for fine adjustment and driving a cloth pulling shaft 133 substantially being shaft 11. The number of gears 15 is, for example, fourteen as shown in FIG. 2 (with gears 15 respectively having teeth ranging from sixteen to twenty-nine).

A fine adjustment device 2 generally comprises a handle 21 provided on the upper cover 19 of the case 1, and a sliding plate 22 having one end 221 pivotally connected to an intermediate wall 101 of case 1, a base 23, and a rack 24 provided in the case 1 as well as rotatable control knobs 25 and 26 provided outside of the case 1. On the sliding plate 22, there is provided an inclined slot 220 and a guiding slot 229. Below the handle 21, there is extending a shaft 210 which is connected with an eccentric block 219 and pivotally inserted into another intermediate wall 102 of case 1. A guiding post 230 is protruded from the base 23 and disposed in the inclined slot 220. Between two sandwiching plates 231 and 232 of base 23, there is rotatably disposed a gear 233 capable of being in mesh with one of the gears 15. The gear 233 drives another gear 234 disposed thereunder so that the latter can drive an indirect shaft mounting thereon gear 234.

The rotatable control knob 25 outside of the case 1 is mounted on an axle 251. At the inner end of the axle 251, is there mounted a gear 252 in mesh with rack 24 which is disposed in a groove defined between one of the supporting rods 10 and one of the inner sides of the case 1. An actuating piece 27 is attached to one end of the rack 24 and extends into a space between the sandwiching plates 231 and 232.

At one end of the indirect shaft 235 there is slidably mounted a gear 236 which is capable of being in mesh with one of the coarse adjustment gears 16 and being shifted to and fro along the shaft 235 by the control knob 26 for coarse adjustment.

In operation, the supporting rods 10 together with case 1 are swiveling through 360 degrees with respect to the circular knitting machine so that the sleeve 14 sleeved on shaft 11 is rotated by the end bevel gear 12 which is in mesh with the bevel gear 13 attached to the base of the machine. Thereby, all of the coarse adjustment gears 16 are rotated and in turn the gear 236 together with the indirect shaft 235 is rotated at a preset speed through the cooperation of the gears 16 and the rear reduction gears 18. Moreover, the gear 234 on the shaft 235 and in turn the gear 233 are rotated so that the gear 15 which meshes with gear 233 is rotated and consequently the power can output through the cloth pulling shaft 133. The cloth winding shaft 132 is rotated by the bevel gear 131 which is in mesh with and driven by the gear 13.

To change the speed ratio between bevel gear 12 (or gear 13 or the revolving swivel frame) and cloth pulling shaft 133, the operator can swing the handle 21 and in turn rotate the eccentric block 219. The whole sliding plate 22 is shifted by the block 219 due to the fact that the latter is constrained to eccentrically rotate within the guiding slot 229. Consequently, the actuating post 230 is displaced by the sliding plate 22. Thereby, the base 23 consisting of the sandwiching plates 231 and 232 is moved backward due to the fact that the inclined slot 220 is inclined. In this situated, the gear 233 is disengaged from the fine adjustment gears 15 and thus in its position ready for adjustment.

When the rotatable control knob 25 is rotated when the gear 233 is disengaged from the fine adjustment gears 15, the rack 24 can be driven by the end gear 252, which is in mesh with the rack 24, on the axle 251. Meanwhile, the actuating piece 27 attached to one end of the rack 24 drives the whole base 23 so that it moves longitudinally along the indirect shaft 235. Therefore, the gear 233 can be meshed with any selected one of the stepwise disposed gears 15 to achieve the purpose of finely changing the speed ratio. In addition, the amount of the longitudinal linear displacement (not shown) of the base 23 caused by the rotational movement of the control knob 25 can be readily determined by calibrating and marking on the circumferential surface of the knob 25 so that by the mark the operator may figure out whether the gear 233 can be in mesh with a specific fine adjustment gear 15 or not.

Different speed reduction ratios between the machine swivel frame and shaft 133 can be achieved by the cooperation of the coarse adjustment sets of gears 16 and the sets of speed reduction gears 18 in that the gear 236 can be displaced axially through the rotation of the other control knob 26 so that it can be meshed with a selected set of gears 16 and thus the effect of a coarse adjustment in speed reduction is obtained.

Figure 5:
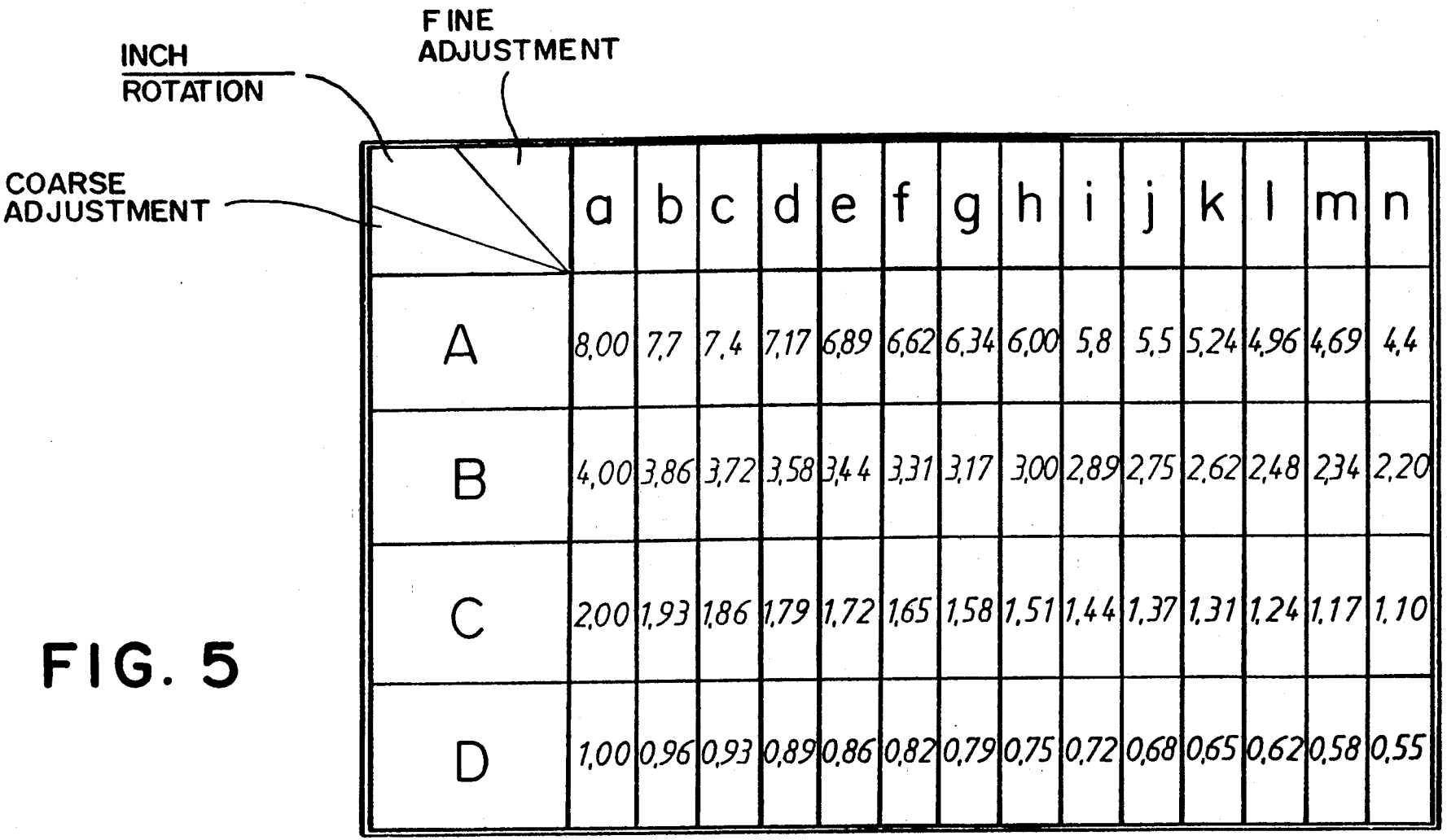
FIG. 5 is a speed changing table in accordance with the invention.

Referring to FIG. 5, it can be seen that 56 speed ratios can be obtained by the use of 14 fine adjustment gears 15 and four sets of coarse adjustment gears 16, as listed in the table of the FIG. 5. That is, any one of the 56 speed ratios can be desirably affected in the manufacture of the fabric by executing the gearing adjustment in the manner described hereinbefore.

Figure 3:
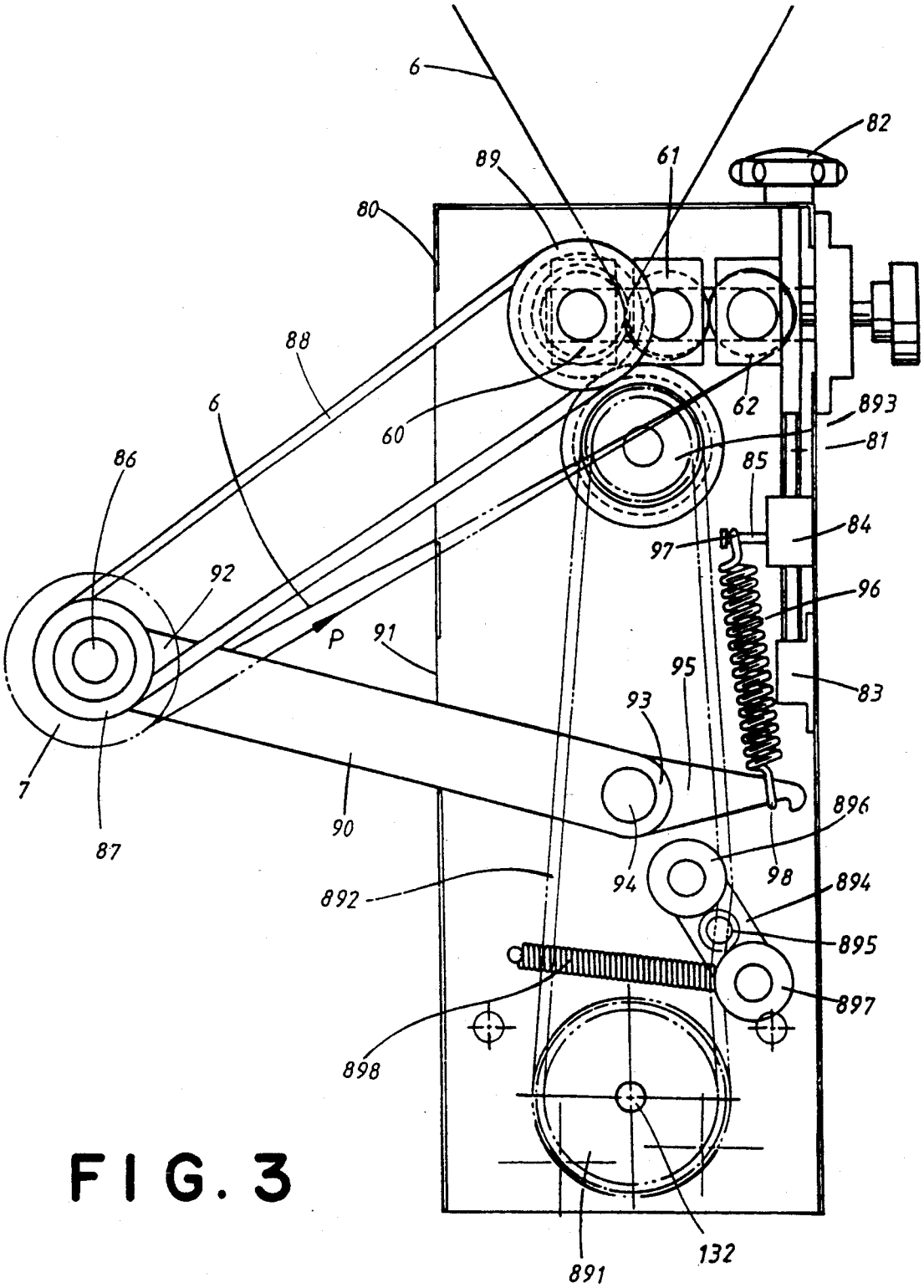
FIG. 3 is a side view showing a circular knitting machine and associated with the cloth winders in accordance with the invention.
Figure 4:
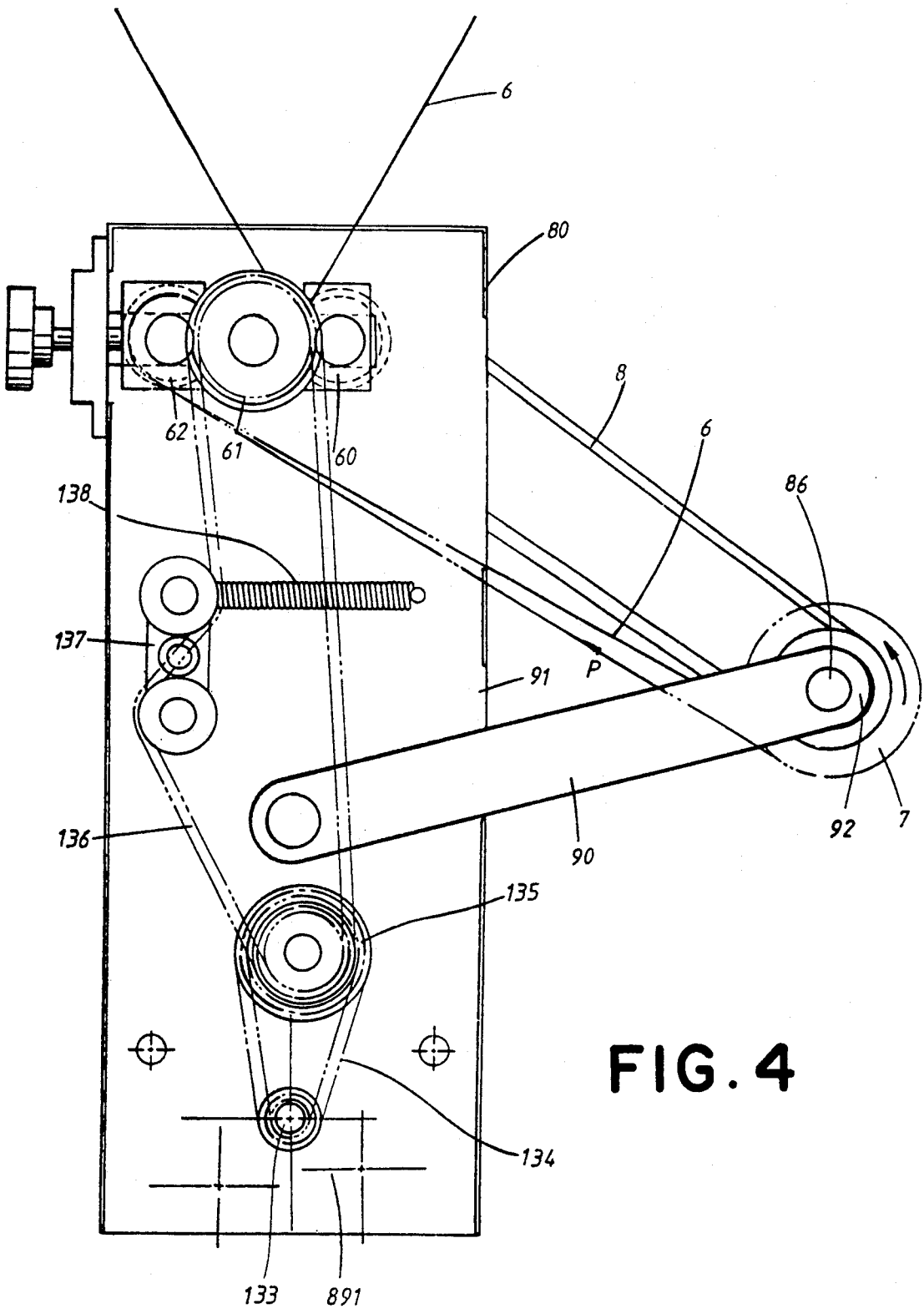
FIG. 4 is similar to FIG. 3 but viewed from the opposite side of the circular knitting machine.

Referring to FIGS. 3 and 4, in a general circular knitting machine, the cloth 6 is transferred to the cloth roller 86 through the set of rollers 60, 61, and 62 mounted on two sides of the swivel frame wherein power is coming from the driving roller 61 which is driven in the present invention by the cloth pulling shaft 133.

Figure 6:
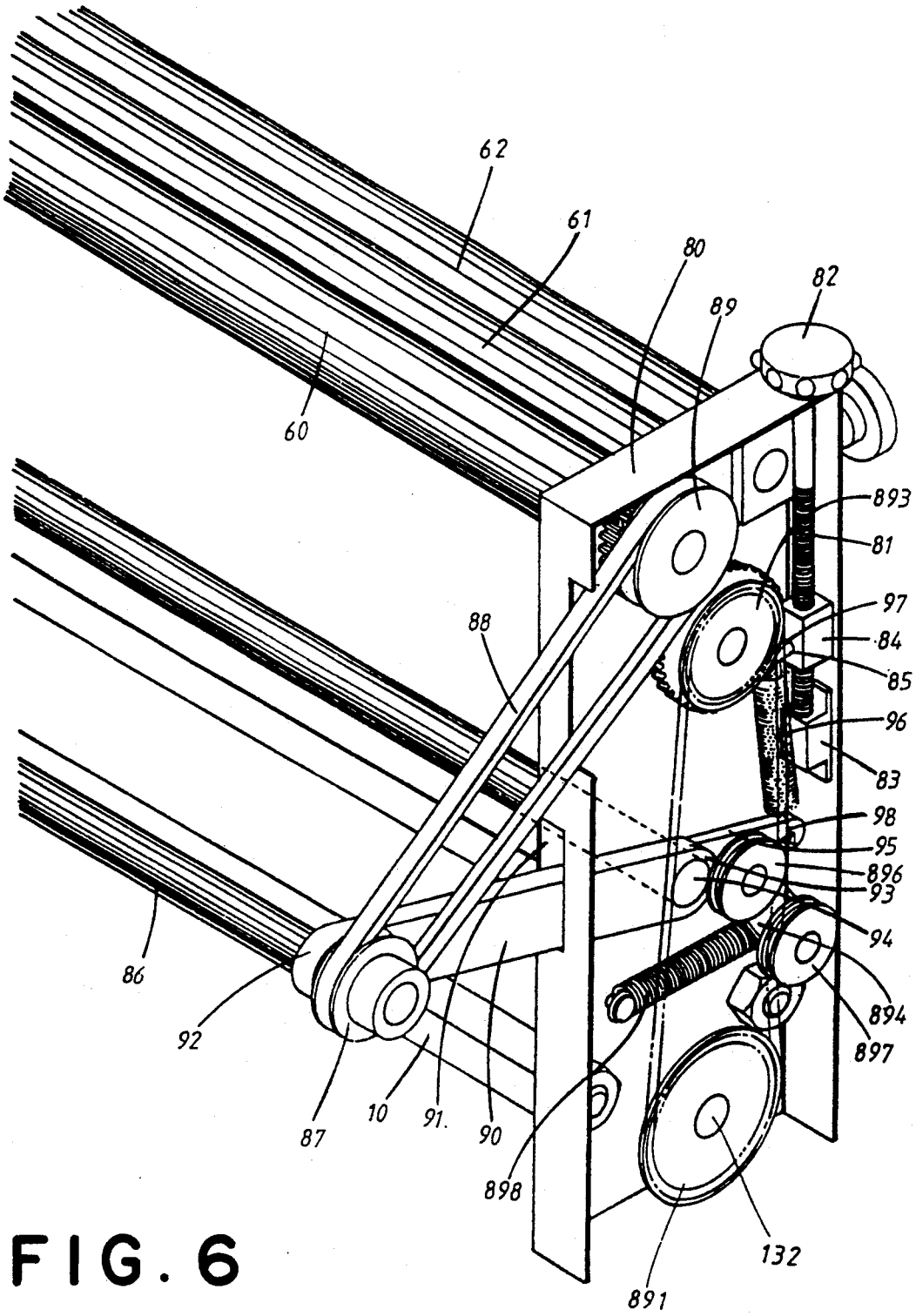
FIG. 6 is a perspective view showing corresponding matching elements of the knitting machine body and the cloth winding device in accordance with invention.
Figure 7:
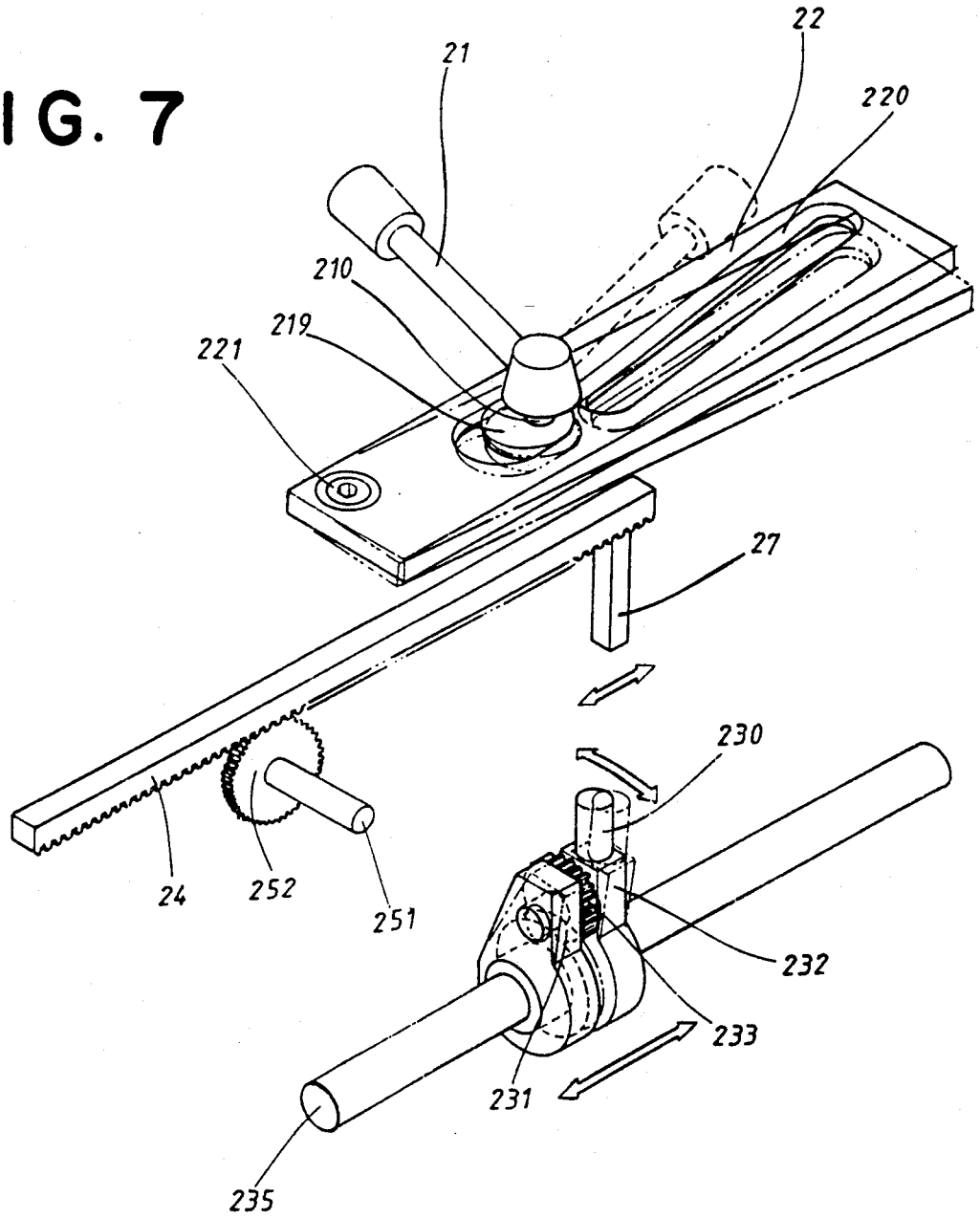
FIG. 7 is an expanded view of the fine adjustment device in FIG. 1.
Figure 8A:
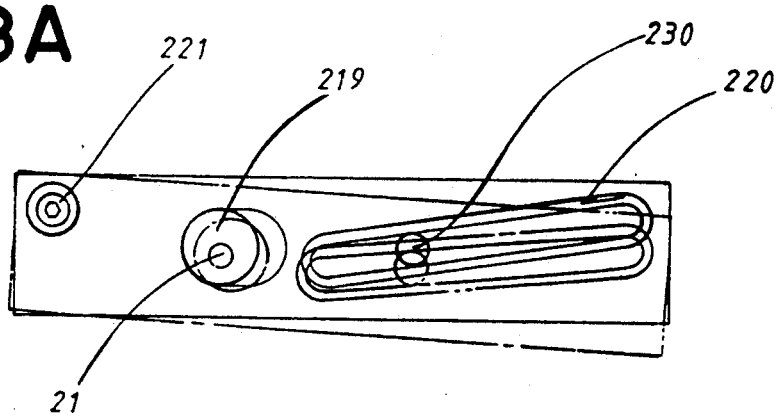
FIG. 8A is a top view of the sliding plate.
Figure 8B:
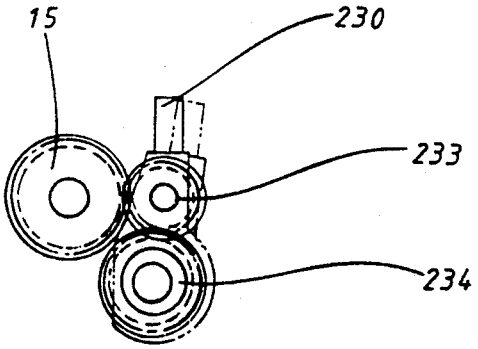
FIG. 8B is a schematic drawing of the intermeshing feature of the fine adjustment device.

Referring to FIGS. 3 and 6, within the side box 80 of the circular knitting machine, there is provided a tension adjustment device including a screw rod 81. On the top of the rod 81, there is provided an adjusting rotary knob 82 which projects beyond the upper surface of the side machine box 80. The bottom end of the screw rod 81 is engaged in the positioning block 83 in the box 80. On the screw portion of the rod 81, there is mounted a distance adjusting block 84 which is formed with a an inner thread for engagement with the rod 81 and has a supporting rod 85 transversely protruded therefrom.

On one end of the roller 86, there is provided a pulley 87 on which is mounted a belt 88 for transmission between the pulley 87 and the other pulley 89 within the side machine box 80. The pulley 89 is indirectly driven by a rotary sprocket wheel 891 mounted on the cloth winding shaft 132 which can be controlled by the gear box at the bottom portion of the machine. The rotary sprocket wheel 891 is coupled to an indirect sprocket wheel 893 through a belt 892. On the side 80, there is provided a slant rocking plate 894 which can rock about the pivot 895 at the middle thereof. Moreover, the belt 892 passes over the inner opposite sides of the rollers 896 and 897. One end of a spring 898 is attached to the machine box 80 and the other end thereof is attached to the lower end of the rocking plate 894 so that the belt 892 can be maintained in its continuously tensioned state by the spring.

Referring to FIGS. 3 and 4, the sprocket-provided cloth pulling shaft 133 by chain 134 drives double sprocket intermediate wheel 135 which in turn by a belt 136 drives an upper sprocket driving roller 61. On side box 80 near one side of the belt 136 there are provided a vertical rocking plate 137 and a spring 138 similiar to the forementioned plate 894 and spring 898 so that the belt 136 can be maintained in its continuously tensioned state to assure a positive transmission.

A rocking arm 90 is disposed so that a portion thereof is inside of the machine box 80 and the other portion is slantly protruding from a slot 91 on side box 80. One end 92 of the arm 90 is pivotably coupled with the roller 86 and the other end thereof 93 is movably pivoted about a supporting axle 94 and joined with an extending plate 95.

One end 97 of the spring 96 is attached to the supporting rod 85 and the other end thereof 98 is attached to the extending plate 95.

Referring to FIGS. 3 and 6, when the finished cloth 6 clamped between rollers 60, 61 and partly wound through rollers 61, 62 is slantly pulled and transferred to the roller 86, the rotary wheel 891 driven by cloth winding shaft 132 drives the pulley 89 through the chain 892 and the gears of intermediate wheel 893 mesh with pulley 89 and therefore the cloth 6 is wound up by the roller 86.

The tightness of the cloth being wound up can be controlled by adjusting the rotatable knob 82 in that when the knob 82 is rotated, the screw rod 81 is rotated therewith and the distance adjusting block 84 is moved up or down along the screw rod 81. Thereby, the spring 96 can provide different tensioning forces so that the cloth can have a desired tightness.

In an early period of winding the cloth by the roller 86, a tangential pulling force P is relatively larger because the cloth roll 7 has a relatively small diameter that is produced by roller 86 (or pulley 87 or belt 88) contacting the cloth 6 which is wound up along a tangential direction of the cloth roll 7 since roller 86 is indirectly driven by cloth winding shaft 132 driven by bevel gear 13. Under the preset tension of the spring 96, the tangential pulling force P has a reaction force having a larger effect on roller 86 than that of the tensioning force of the spring 96 on roller 86 so that the roller 86 together with the roll 7 is tends to be lifted up. Due to this, the rocking arm 90 is pivoted about its pivot 94 so in a manner that the end 92 of the rocking arm 90 will be slightly lifted up with the roller 86.

When the roller 86 tends to be lifted up, the distance between the pulleys 87 and 89 is slightly reduced and thus the belt 88 is slightly slackened and in turn the pulling force to the cloth 6 is slightly reduced so that the pulling force tends to be constantly maintained. In a latter period of the cloth winding process, the pulling force is smaller due to the bigger and heavier roll 7 causing the end 92 of the rocking arm 90 to be pressed down. Therefore, the tension in the belt 88 increases to in turn increase the pulling force to cloth 6 so that the pulling force in this period also tends to be maintained constant. Consequently, the roller 86 can continuously and effectively adjust itself automatically to maintain a specific pulling force for the cloth during the cloth winding process. Thereby, the cloth can maintain the same tightness throughout the winding process.

While only one preferred embodiment of the invention has been shown and described, it will be understood that this invention is not limited thereto since modifications can be made thereto by and will become apparent to those skilled in the art.

I claim:

1. A cloth winding device for a circular knitting machine comprising a base, and a swivel frame having support rods, a left side and a right side;

a case positioned on said support rods and housing gear means having coarse gears for receiving an input rotation and fine gears for rotating a cloth tensioning shaft, said fine gear including a plurality of fine adjustment gears secured on said cloth tensioning shaft, and adjustment means for selective coupling together one of said course gears and one of said fine gears for rotating said cloth tensioning shaft at different speeds relative to said input rotation;

said course gears including a sleeve, a plurality of coarse adjustment gears secured to said sleeve, and a plurality of adjacent rear row reduction gears respectively meshing with said plurality of coarse adjustment gears, a first bevel gear on an end of said sleeve, a second bevel gear meshing with said first bevel gear and providing said input rotation, and a third bevel gear attached to a cloth winding shaft and meshing with said second bevel gear; said cloth winding shaft and said cloth tensioning shaft being coaxially arranged;

a driving roller coupled to and driven by said cloth winding shaft;

a set of rollers coupled to and driven by said driving roller, set of rollers mounted between said left and right sides of said swivel frame;

a rocking arm having a first end attached to a cloth roller and a second end protruding into said swivel frame and pivotally connected to a supporting shaft mounted in said swivel frame;

said cloth roller coupled to and driven by one roller of said set of rollers through a first belt and receiving a knitted cloth thereabout; and a tension adjustment means mounted on said swivel frame mounted and secured to an extension element extending from said second end of said rocking arm for controlling a knitted tightness of said knitted cloth.

2. The cloth winding device according to claim 1, wherein said plurality of fine adjustment gears are arranged in series and have from 16 to 29 teeth.

3. The cloth winding device according to claim 1, wherein said coarse adjustment gears comprise four sets of gears.

4. The cloth winding device according to claim 1, wherein said fine adjustment gears and said coarse adjustment gears cooperate to provide 56 different of speed reduction ratios.

5. A cloth winding device according to claim 1, wherein said adjustment means includes:

a sliding plate provided on said case having one end pivotally connected to said case, an inclined slot and a guiding slot, a shaft extending through said inclined slot having a first end attached to a handle, a second end pivotally secured to said case and a middle portion secured to an eccentric block slidably held in said guiding block, an indirect shaft, first and second adjusting gears each slidable on said indirect shaft and rotated by said indirect shaft, said first adjusting gear selectively coupling with one of said plurality of fine adjustment gears through an intermediate gear arranged therebetween, said second adjusting gear selectively meshing with one of said course adjustment gears, a base located below said sliding block having a guiding post received in said guiding slot, and two sandwich plates rotatably securing therebetween said first adjusting gear a rack provided in a groove located in one of said supporting rods and said case and having at one end thereof an actuating piece extending between said two sandwich plates, a first axle supported by said case having a first end connected to a rack gear meshing with said rack and a second end connected to a first adjusting knob, means including a second control knob for moving said second adjusting gear along said indirect shaft, wherein when said handle is in a first position said first and second gears respectively engage with one of said fine adjustment gears and one of said coarse adjustment gears and when said handle is pivoted to a second position said eccentric block turns within said guiding block and displaces said sliding plate together with said guiding post held in said guiding slot respectively disengaging said first and second adjusting gears from one of said fine adjustment gears and one of said coarse adjustment gears and permitting movement of said first and second adjusting gears along said indirect shaft respectively by said first and second adjusting knobs.

6. A cloth winding device according to claim 1, comprising further means for driving said cloth roller including a wheel driven by said cloth winding shaft; a second belt driven by said wheel; an indirect wheel driven by said second belt; said indirect wheel driving a pulley; said pulley driving said cloth roller using said first belt; a rocking plate pivotally mounted on said swivel frame and positioned near said second belt; and a spring having a first end attached to said swivel frame and a second end attached to a lower portion of said rocking plate for maintaining said second belt in a tensioned state.

7. The cloth winding device according to claim 6, wherein said rocking plate is positioned between two rollers through which a portion of said second belt passes.

8. A cloth winding device according to claim 1, wherein said cloth winding shaft drives a double sprocketed intermediate wheel through a second belt and said intermediate wheel drives said driving roller; and said second belt passes between two rollers on a rocking plate mounted on said swivel frame and is tensioned by a spring connected to said rocking plate.

9. A cloth winding device according to claim 1, wherein said tension adjusting means includes:

a screw rod having a top and a bottom end;

a rotatable adjusting knob positioned on said top end and projecting beyond said swivel frame;

a positioning block attached to said bottom end of said screw rod;

a distance adjusting block mounted on said screw rod; and a spring having a first end attached to a laterally extending support rod on said distance adjusting block and a second end attached to an extension element extending from said rocking arm.

10. The cloth winding device of claim 9, wherein said distance adjusting block contains an inner thread for slidably moving along said screw rod.

* * * * *